US005474717A

United States Patent [19]

Bucher et al.

[11] Patent Number: 5,474,717

[45] Date of Patent: Dec. 12, 1995

[54] APPARATUS INCLUDING MEANS FOR CONTROLLING THE FORMATION OF AN ICE BANK IN A CARBONATOR TANK

[75] Inventors: Bernhard Bucher, Pfinztal; Raimond Gatter, Bretten, both of Germany

[73] Assignees: The Coca-Cola Company, Atlanta, Ga.; Bosch-Siemens Hausgerate GmbH, Munich, Germany

[21] Appl. No.: 425,050

[22] Filed: Apr. 19, 1995

Related U.S. Application Data

[63] Continuation of Ser. No. 233,968, Apr. 28, 1994, abandoned, which is a continuation of PCT/EP93/02284, Aug. 25, 1993.

[30] Foreign Application Priority Data

Aug. 28, 1992 [DE] Germany ..... 42 28 773.1

[51] Int. Cl.[6] ..... B01F 3/04

[52] U.S. Cl. ..... 261/140.1; 261/DIG. 7; 62/59

[58] Field of Search ..... 261/140.1, DIG. 7; 62/59; 165/181

[56] References Cited

U.S. PATENT DOCUMENTS

Re. 18,826 5/1933 Thomson ..... 62/59

3,154,141 10/1964 Huet ..... 165/181

FOREIGN PATENT DOCUMENTS 471343 2/1992 European Pat. Off. .
3016941 11/1981 Germany .
2059791 4/1981 United Kingdom .

OTHER PUBLICATIONS

International Search Report and U.S. counterpart U.S. Pat. No. 5,184,942 to EPO reference 471,343.

*Primary Examiner*—Tim R. Miles

[57] ABSTRACT

Apparatus for mixing fresh water with $CO_2$ gas to produce carbonated water in a cooled storage tank, includes a space located along the wall of the storage tank adjacent the cooling coils of a cooling system where water flow is partially or fully impeded so that ice can crystallize during the formation of an ice bank in the storage tank. In one configuration, the space is provided by a small section of open pipe mounted on the storage tank wall in the area of the cooling coils. Another configuration includes an apertured structure of rectangular cross section located on the tank wall. Still another configuration consists of an outward projection of a section of the wall of the storage tank which extends between two cooling coils, with an apertured plate covering this projection. Such a space can also be realized by a roughened wall section surface in the immediate vicinity of the cooling coils.

12 Claims, 1 Drawing Sheet

APPARATUS INCLUDING MEANS FOR CONTROLLING THE FORMATION OF AN ICE BANK IN A CARBONATOR TANK

This application is a continuation of application Ser. No. 08/233,968 filed on Apr. 28, 1994, now abandoned, which is a continuation of International Application PCT/EP93/02284, with an international filing date of Aug. 25, 1993.

BACKGROUND OF THE INVENTION

This invention relates to apparatus for mixing water with $CO_2$ gas to produce carbonated water in a storage tank and operates to cool its contents and to form an ice bank adjacent the cooling pipes of a cooling circuit in the wall area of the storage tank, whose interior also includes the placement of a circulating pump, whereby $CO_2$ gas from the head-space of the storage tank is mixed by rotation and/or circulation with the water inside the storage tank. Both fresh water and $CO_2$ gas are fed into the head-space of the storage tank while carbonated water is removed from the base or bottom of the tank.

Apparatus which mixes water with $CO_2$ gas to produce carbonated water is well known and is used, for example, in post-mix beverage dispensing machines so that carbonated beverages can be prepared and dispensed on demand by mixing carbonated water with a suitable drink concentrate. The carbonated water mixed with the drink concentrate is produced directly in the storage tank by mixing water and $CO_2$ gas which is fed thereto and thereafter cooled for better carbonation, this being a requirement for a cool refreshing drink which is prepared for consumption as the need arises. The storage tank, commonly referred to as a carbonator, is fed fresh water of drinking quality either from the line of a water supply system or a pressurized storage tank. The fresh water, moreover, can be fed from the water supply system under pressure and can be enhanced, when desired, by the use of a pressure pump. Further, $CO_2$ gas is fed to the carbonator from a $CO_2$ gas storage tank by a pressure-reducing regulating valve so that a pressure of, for example, about 4 bars is built up in the carbonator.

In order to ensure sufficient carbonation of the fresh water, the carbonation process can be accomplished by or assisted by the use of a $CO_2$ circulating pump located in the carbonator. This type of pump draws $CO_2$ gas from the head-space region of the carbonator filled with $CO_2$ gas and blends it with circulating water which is set in circular motion, such as by spinning.

As already noted, cooling of the carbonator is used, not only to improve the carbonation, but also as a requirement so that the finally prepared and dispensed drink exhibits a desired low and basically constant temperature. The cooling of the carbonator is achieved by a cooling system, which is adapted to form an ice bank of generally uniform thickness along the inner side walls of the carbonator as a result of the circulating water. Consequently, a cooling capacitor is produced, thus enhancing its "refrigerating capacity", thereby removing the need for a relatively powerful cooling system which would be necessary in a once-through cooling system.

Arrangements having a corresponding design as described above are well known, a typical example being shown and described in U.S. Pat. No. 5,184,942, Deininger et al, Feb. 9, 1993.

In the dispensing of a freshly prepared carbonated drink, a shutoff valve is typically opened in a line connected to the bottom of the carbonator, whereupon cooled carbonated water is fed therefrom to a concentrate mixing station.

As a result of forming the ice bank in the area of the cooling coils, the carbonated water is cooled to near the freezing point. As such, an inherent danger exists due to the fact that the ice particles or pieces of ice floating in the carbonated water can get into the area of the outlet which can become clogged. Ice formation in this area is substantially impossible due to the fact that relatively warmer water tends to sink because of the special behavior of water relative to its specific density near the freezing point, and because the discharge opening is normally placed in the immediate vicinity of the circulating pump which also radiates a certain amount of heat. However, the circulating movement of the water, which is necessary or at least helpful for carbonation and for uniform formation of the ice bank on the walls of the carbonator, causes detached floating or otherwise suspended ice in the upper areas, particularly those with open dispensing channels, to accumulate in and clog the outlet region.

The formation of the ice bank inside the storage tank is intended to take place in areas which do not jeopardize the operation of the storage tank as a carbonator. Such areas include the thermally conducting side walls of the storage tank, which are externally surrounded by the cooling coils of the cooling system. There ice formation continues to develop; however, the pre-existing ice bank will also be enlarged as a result of further cooling. The problems encountered in the operation of such carbonating storage tanks have indicated that with carbonated water, it can be cooled below the typical freezing temperature, but due to continuous removal of heat during use, ice formation ceases to take place on the ice bank as desired. By heat flow and convection, temperature values can be reached inside the storage tank which lies below the actual freezing point, with the result that a spontaneous freezing process can occur anywhere in an undesirably uncontrolled manner at many different points or the formation of salt results over a wide area. Thus, the desired ice formation on the walls in the immediate vicinity of the cooling coils of the cooling system does not normally occur, or can be achieved only with annoying delay.

SUMMARY OF THE INVENTION

It is the principal object of this invention, therefore, to overcome an uncontrolled ice formation in the storage tank of a carbonator in an efficient and economical manner.

Apparatus for mixing fresh water with $CO_2$ gas to produce carbonated water in a cooled storage tank, which meets this objective comprises means located along the wall of the storage tank adjacent the cooling coils of a cooling system where ice can crystallize during ice formation at a predetermined location relative to other areas in the storage tank. Such means include a space where water flow is partially or fully impeded. This space is relatively small in size preferably being smaller than 100 $mm^3$ and when desirable can be made smaller than 10 $mm^3$.

A preferred embodiment of the invention comprises a small section of open pipe mounted on the storage tank wall in the area of the cooling coils. Another preferred embodiment is formed by an outward projection of a section of the wall of the storage tank and which extends between two cooling coils, with an apertured plate covering this projection to the greatest possible extent relative to the interior of the storage tank. Yet another preferred embodiment is realized where the wall of the storage tank is partially roughened in the upper area thereof in the immediate vicinity of the cooling coils and where the storage tank wall is otherwise made smooth in the lower area thereof.

As a result, one or more crystallization points are provided so that ice generation is started in a predetermined, desired area, from which the formation of the ice bank in the presence of suitably cool water occurs as required. The isolation of a small amount of liquid from the total liquid in this relatively small space partitioned with respect to flow brings about a specifically preferred ice formation, which spreads uniformly over the storage tank wall adjacent the cooling coils. Although the crystallization spaces are particularly useful in accomplishing localized ice formation, it has also turned out that a partial roughening of the storage tank walls in the area of the cooling pipes relative to otherwise smooth walls can provide a usable contribution to the desired end effect because in this area, the convection of the water is inhibited.

BRIEF DESCRIPTION OF THE DRAWINGS

The details of the invention as set forth will be more readily understood when considered together with the accompanying drawings, wherein.

DETAILED DESCRIPTION OF THE INVENTION

Figure 1:
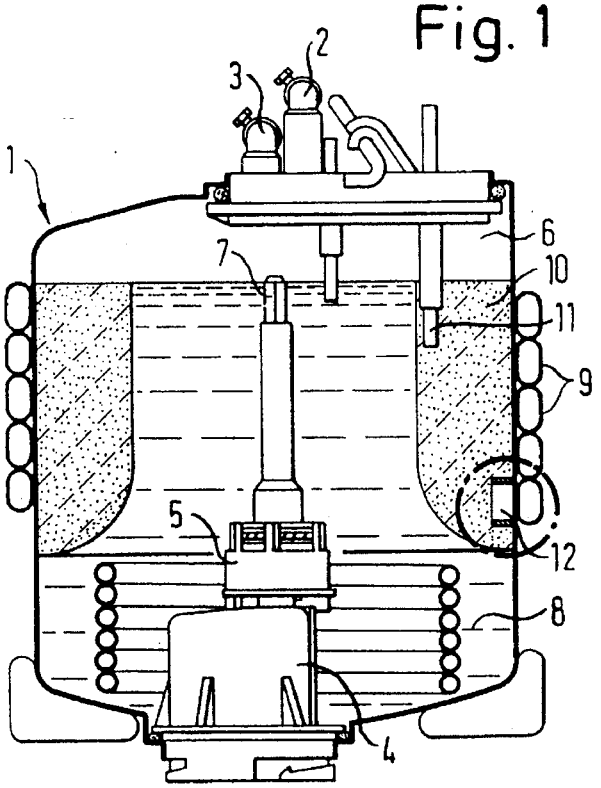
FIG. 1 is a schematic illustration of a storage tank cooled from outside of a set of cooling coils and including a preferred embodiment of the invention.

Referring now to the drawings, a storage tank 1, as depicted in FIG. 1, is used in connection with apparatus, such as a carbonator for preparing post-mix beverages by adding a suitable concentrate to carbonated water or simply to fresh water when carbonation is not desired. As necessary, fresh water is fed into the storage tank 1 by a feed pipe 2 and $CO_2$ gas is fed thereto by a feed pipe 3.

To prepare a post-mix beverage, a measured amount of cooled carbonated water in storage tank 1 is removed by an output line, not shown, at the bottom of the tank. Carbonation takes place and is at least assisted by a circulating pump 5, driven by an electric motor 4, which draws $CO_2$ gas from a head-space region 6 of storage tank 1 by a suction pipe 7 where mixes it with the stored water at the level of circulating pump 5. As a result, the $CO_2$ gas is dissolved and blended with water 8 to produce carbonated water.

The cooling of the water supply takes place by a set of evaporator coils 9 of a cooling system, not shown, and located on the outer surface of a thermally conducting tank wall. An ice bank 10 is formed on the inner wall surface of the storage tank 1 adjacent evaporator coils 9. The thickness of the ice bank 10 is monitored in a well known manner by an ice sensor 11. The sensor 11 controls the refrigeration circuit and thus the refrigerating capacity of the system. The ice bank 10 produces a very constant water temperature near the freezing point and provides a desired refrigerating capability when dispensing cold water from the storage tank and when relatively warmer water is added to the storage tank during refilling. The set of coils in the lower section of the tank adjacent the electric motor 4 and the circulating pump 5 is for cooling a separate source of fresh water for use when desired.

Figure 2A:
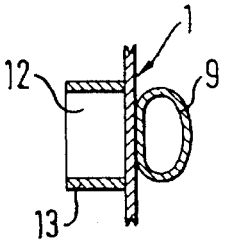
FIGS. 2*a* to 2*d* are partial cross sectional diagrams illustrating the preferred embodiments of the invention.

To initially start the formation of the ice bank 10, a crystallization space 12 in the interior of the storage tank 1 is provided. This space slows or stops the flow of water in the vicinity of the bottommost turn of the evaporator coil 9 located on the outside of a thermally conducting side wall of the storage tank 1. FIG. 2*a* further depicts this space. As shown, the space 12 is located in an area inside of a small length of pipe 13 which is mounted perpendicularly to the wall of storage tank 1 relative to a turn of evaporator pipe 9. This space 12 defines a zone where water can easily crystallize when it cools below the freezing point. Accordingly, ice initially forms in the space 12 and then spreads from this crystallization point, forming an ice bank 10 relatively quickly and suddenly or the inner wall surface of the tank next to the evaporator coils 9. In contrast, the other areas inside storage tank 1 remain ice-free. Above this crystallization point in the space 12, a relatively lower cooling temperature will be encountered because of the density verses temperature characteristic of water. Therefore, the ice formation rapidly develops upward.

Figure 2B:
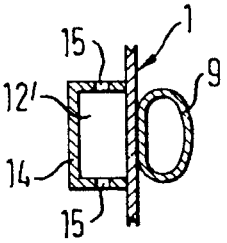

FIG. 2*b* discloses an embodiment wherein a crystallization space 12' is provided and being comprised of a partially closed space including a structure of rectangular cross section secured to the interior of the storage tank 1 and having two side walls which include small bores 15. As a result, the space 12' can readily be filled with water and from where ice crystals form and propagate unhindered outwardly from the bores 15.

Figure 2C:
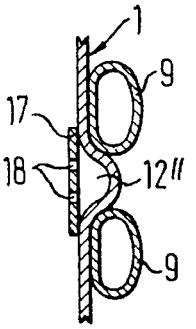

Referring now to FIG. 2*c*, shown thereat is a crystallization space 12" for the formation of ice crystals. As shown, it is produced by an outward indentation in the wall of storage tank 1 between two turns of the evaporator coil 9 and which is covered by a small flat cover plate 1 having two small openings 18.

Figure 2D:
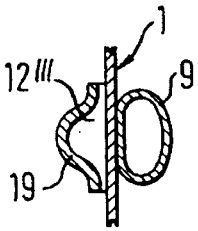

FIG. 2*d* shows yet another embodiment for producing a crystallization space. There an open space 12''' is formed under a curvilinear inwardly protruding open ended cap member mounted on the inside wall of the storage tank 1 directly opposite a turn of evaporator coil 9. In each instance, liquid from the storage tank 1 must be allowed to enter the closed space 12', 12", and 12''' where it remains until the ice crystals form to start the ice build-up for the ice bank 10.

Also, ice crystallization can be initiated by a roughened area of the interior wall surface of the storage tank 1 next to the cooling coils 9 by inhibiting the water flow sufficiently for crystallization of the water to occur.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. Apparatus for mixing fresh water with $CO_2$ gas to produce carbonated water, comprising:

a water storage tank for holding cooled water;

a set of cooling coils located around an upper portion of said storage tank for cooling the water in said storage tank and for forming an ice bank on an inner wall surface thereof;

a circulating pump located inside the storage tank for mixing $CO_2$ gas with water in the storage tank and forming carbonated water thereby; and, means located adjacent a lowermost coil of said set of cooling coils on the inner wall surface of the storage tank for forming a discrete relatively small crystallization space inside the storage tank which impedes the flow of water therein to initiate crystallization of the water at said crystallization space whereupon the crystallization will then spread upward so as to form said ice bank over the upper portion of said inner wall surface of the storage tank as a result of a cooling effect provided by said set of cooling coils.

2. The apparatus according to claim 1 wherein said means comprises a roughened area of said inner wall surface of the storage tank in the vicinity of said set of cooling coils.

3. The apparatus according to claim 1 wherein said space is less than 100 $mm^3$.

4. The apparatus according to claim 1 wherein said space is less than 10 $mm^3$.

5. The apparatus according to claim 1 wherein said means comprises an open ended piece of pipe mounted on said inner wall surface of the storage tank.

6. The apparatus according to claim 1 wherein said means comprises a relatively small length of pipe mounted perpendicularly to said inner wall surface of the storage tank adjacent the lowermost coil of said set of cooling coils.

7. The apparatus according to claim 1 wherein said means comprises a section of pipe having a plurality of walls including at least one bore in one of said walls.

8. The apparatus according to claim 7 wherein said section of pipe has a generally rectangular cross section.

9. The apparatus according to claim 7 wherein said means comprises an outward indentation of said wall surface between two coils of said set of cooling coils and a cover plate member including at least one opening thereon covering said indentation.

10. The apparatus according to claim 9 wherein said cover plate member comprises a generally flat cover plate member.

11. The apparatus according to claim 1 wherein said means comprises an inwardly protruding curvilinear cap member mounted on said inner wall surface of the storage tank.

12. The apparatus according to claim 11 wherein said cap member is open at least at one end thereof.

* * * * *